United States Patent [19]

Tuckey

[11] Patent Number: 4,569,637

[45] Date of Patent: Feb. 11, 1986

[54] IN-TANK FUEL PUMP ASSEMBLY

[75] Inventor: Charles H. Tuckey, Cass City, Mich.

[73] Assignee: Walbro Corporation, Cass City, Mich.

[21] Appl. No.: 582,125

[22] Filed: Feb. 22, 1984

[51] Int. Cl.[4] ..... F04B 35/04; F04B 39/12

[52] U.S. Cl. ..... 417/360; 417/363; 417/410; 417/435

[58] Field of Search ..... 417/360, 363, 366, 424, 417/422, 434, 435, 410, 421, 423 H, 902; 137/565, 576; 181/207, 204

[56] References Cited

U.S. PATENT DOCUMENTS

| | | | |
|---|---|---|---|
| 1,953,606 | 4/1934 | Hobson | 417/410 |
| 2,174,444 | 9/1939 | Lofgren | 417/363 |
| 2,261,915 | 11/1941 | Korte et al. | 417/424 |
| 2,674,405 | 4/1954 | Cawl | 417/363 |
| 2,804,019 | 8/1957 | Schaefer | 417/424 |
| 3,014,623 | 12/1961 | Horn et al. | 417/410 |
| 3,179,033 | 4/1965 | Limberger | 417/422 |
| 3,659,965 | 5/1972 | Ebert et al. | 417/363 |
| 3,915,351 | 10/1975 | Kiralfy | 417/424 |
| 4,304,530 | 12/1981 | Gens | 417/360 |

FOREIGN PATENT DOCUMENTS

| | | | |
|---|---|---|---|
| 0085109 | 4/1957 | Netherlands | 417/424 |

*Primary Examiner*—Cornelius J. Husar
*Assistant Examiner*—Peter M. Cuomo
*Attorney, Agent, or Firm*—Barnes, Kisselle, Raisch, Choate, Whittemore & Hulbert

[57] ABSTRACT

A fuel tank mount for in-tank electric fuel pumps to reduce noise and vibration which includes a sealed outer shell spaced from the elongate housing of the fuel pump and supported in and isolated from the pump by resilient seals. The fuel pump and surrounding shell are supported on a fuel tank top closure. One modification utilizes a wire support. A second modification utilizes a direct mount to the top closure. A vapor by-pass is disclosed for one embodiment which closes in response to liquid fuel under pressure.

1 Claim, 7 Drawing Figures

2
2
45
46
30
32
34
40
22
36
38
68
92
90
76
94
77
74
80
86
82
88
84
70
66
20
50
24
60
64
62
52
64
56
55
54

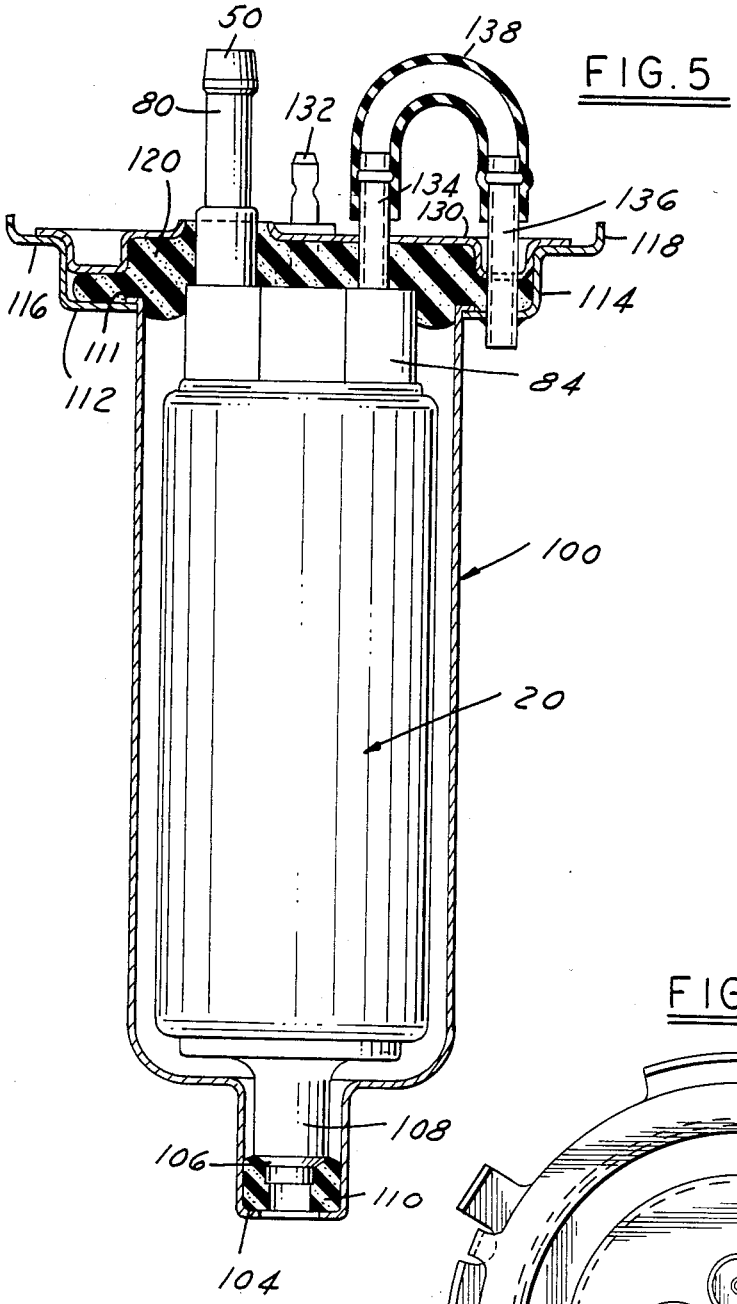
FIG. 5
FIG. 6
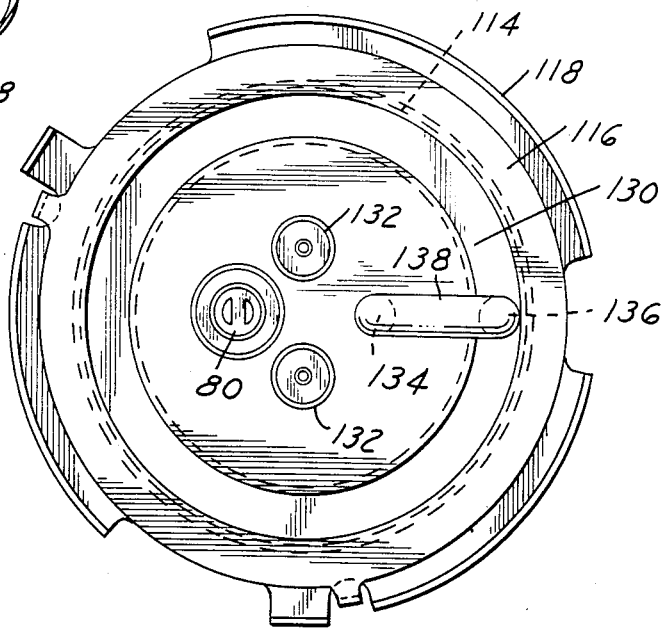

IN-TANK FUEL PUMP ASSEMBLY

FIELD OF INVENTION

Automotive fuel pumps operating within a fuel tank and the mounting within the tank.

BACKGROUND OF INVENTION

Fuel pumps powered by the electrical system of an automotive vehicle have been mounted within the fuel tank of the vehicle but problems have arisen relative to the noise of the pump. At high speeds and higher pressure ranges, the pump will emit a humming noise which is annoying to passengers in the vehicle.

Pressure in these pumps, sometimes as high as 60 pounds per square inch, can be carried by hoses for connections but when the hose is made strong enough to withstand the pressures, it is also stiff enough that it will transmit vibration to the tank and thence to the vehicle.

It is an object of the present invention to provide an in-tank pump mount which will isolate the pump in a manner to prevent noise and vibration from being transmitted to the fuel tank and vehicle.

It is a further object to provide a simplified pump assembly with a self-locking cover for a tank opening and one which meets all the safety standards relative to fuel tank leakage.

Another object is the elimination of difficult hose connections and wire connections presently used in in-tank pump mounts. A further feature is the provision of an air space around the pump and within a surrounding chamber entirely sealed from the fuel in the fuel tank so that a sound and vibration barrier is provided.

Other objects and features of the invention will be apparent in the following description and claims in which the invention is described and details are provided to enable persons skilled in the art to practice the invention all in connection with the best mode presently contemplated for the invention.

BRIEF DESCRIPTION OF THE DRAWINGS

DRAWINGS accompany the disclosure and the various views may be briefly described as:

FIG. 5, a vertical sectional view of a modified tank mount.

FIG. 6, a plan view of a tank closure for the modified mount.

DETAILED DESCRIPTION OF THE INVENTION AND THE MANNER AND PROCESS OF USING IT

Figure 1:
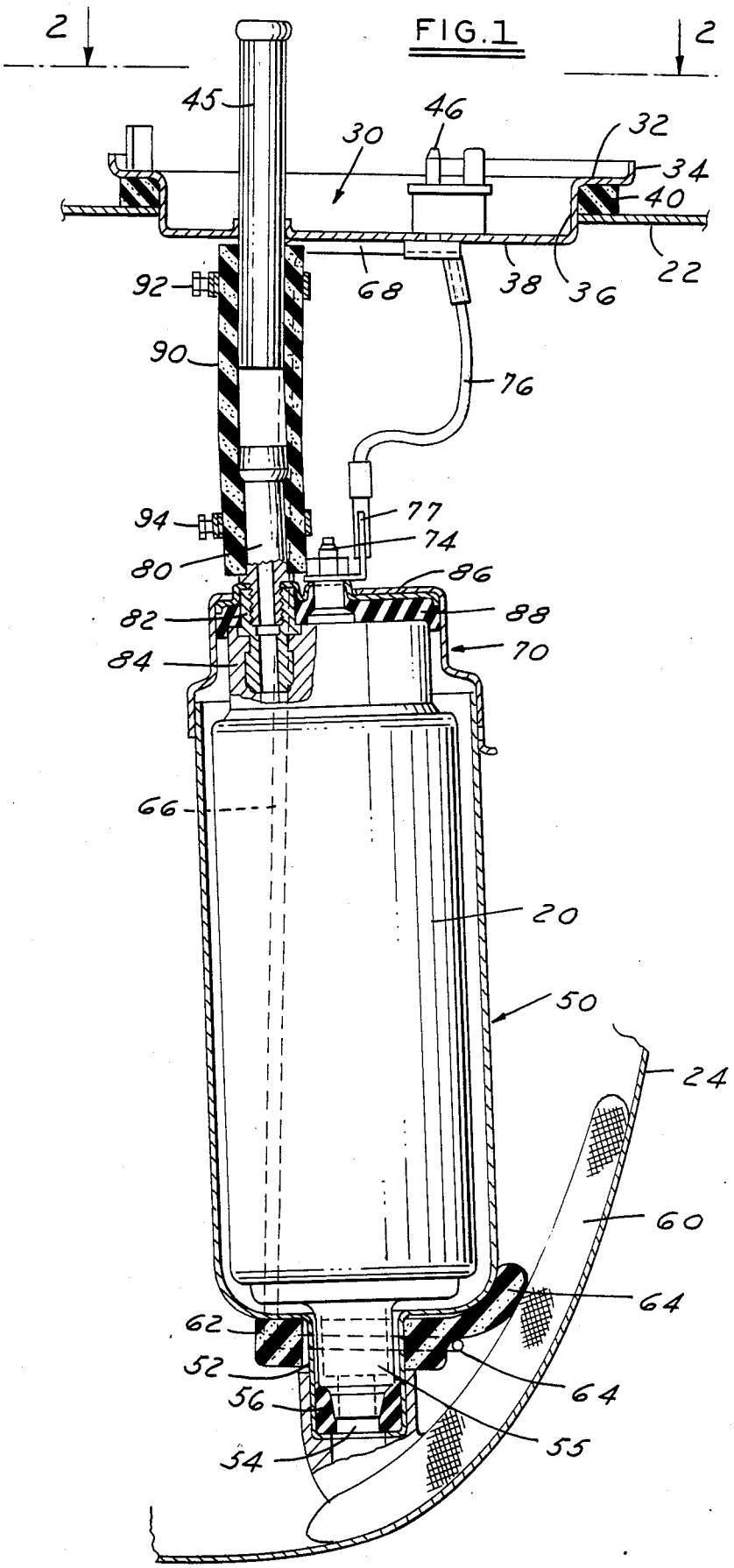
FIG. 1, a view of a pump mount partially in section as disposed in a fuel tank.
Figure 2:
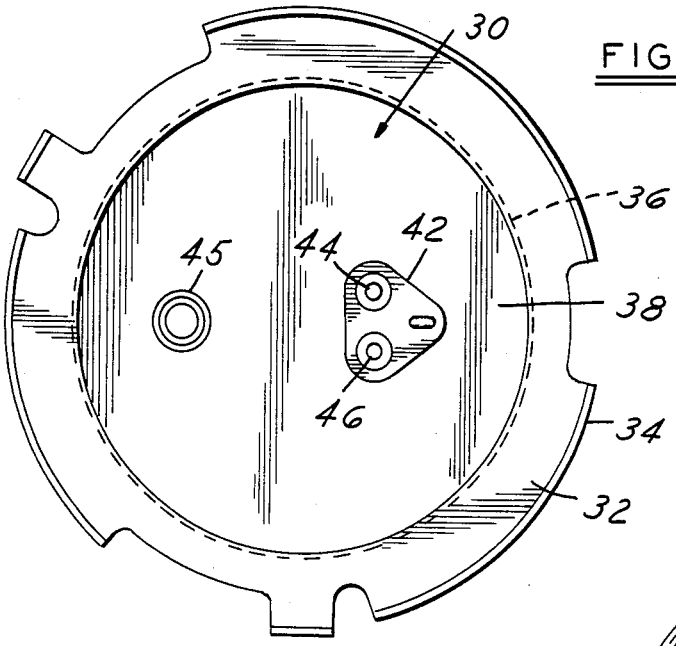
FIG. 2, a plan view of a tank closure plate taken on line 2—2 of FIG. 1.
Figure 4:
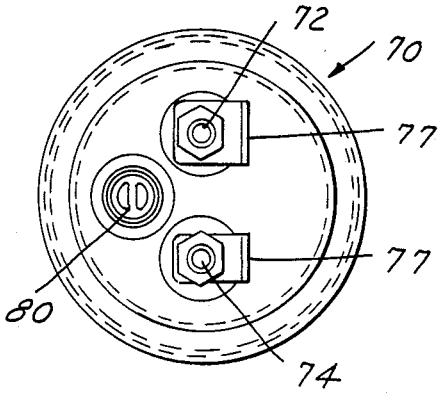
FIG. 4, a view of the top of the pump container.
Figure 3:
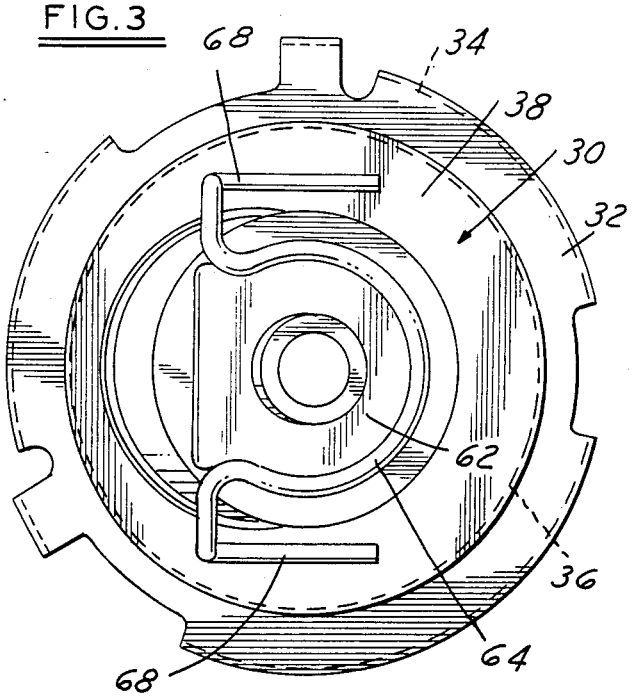
FIG. 3, a bottom view of the tank closure and assembly shown in FIGS. 1 and 2.

In FIG. 1, a vertical section of a pump assembly installed in a fuel tank is illustrated. The cylindrical pump shell 20 houses an elongate pump assembly which may include a positive displacement pump or gear rotor pump driven by the armature of an electric motor within the shell. Examples of this type of pump are found in my U.S. Pat Nos. 4,352,641 issued Oct. 5, 1982 and 4,401,416 issued Aug. 30, 1983.

The present invention is directed to the mounting of the pump shell 20 in a fuel tank of an automotive vehicle. In FIG. 1, sections of the top and bottom of the metal tank are shown at 22 and 24 respectively.

The top 22 of the tank has a circular opening which receives a circular self-locking top cover element 30 which has a radial flange 32 and an upturned flange 34 above a dished portion 36 and a bottom 38. A soft insulator seal ring 40 is compressed against the top of the tank 22 by the flange 32 and the cover element is secured in the tank by suitable means. The ring 40 is made of a material which is resistant to hydrocarbons and serves as a seal.

An electric connector block 42 is mounted on the top side of the bottom plate 38 with poles 44, 46 for connection to the vehicle electric system. A hole in the cover plate 38 receives an outlet connector tube 45 which will be connected to the fuel line leading to the engine.

Reverting now to the pump shell 20, we find an outer metallic shell 50, the walls of which are spaced from the shell 20. The shell 50 terminates at the bottom end in a restricted neck 52 open at the bottom end to receive a fuel inlet nipple 54 extending from the lower end cap 55 of the pump shell 20. A rubber elastomer seal 56 surrounds the nipple 54 and fills the space between the inner wall of neck 52 and the nipple 54. A shoulder on extension frame end cap 55 rests on the seal 56 to insolate the pump from the outer shell 50. The nipple 54 extends to a fuel filter lying along the bottom and side wall of the tank 24. Surrounding the neck portion 52 is a hydrocarbon resistant pad 62 which has a tongue portion 64 resting against the filter 60.

Surrounding and engaging the pad 62 is a loop 64 of a wire sustainer element which has upward extension runs 66 terminating in transverse legs 68 welded to the bottom 38 of cover 30. This sustainer supports the assembly but would permit the assembly to swing into the tank in the event of a tank crushing force. This would prevent the puncturing of the tank by the pump assembly.

The outer shell 50 is capped by a cup-shaped cover element 70, the outer wall of which telescopes over the open end of shell 50. Electrical connector posts 72, 74 extend through the cover element 70 and connect to terminals extending out of the pump shell 20. Wires 76 clip on to extensions 77 to connect posts 44, 46 to the posts 72, 74.

A fuel outlet nipple 80 is secured at the bottom end in a connector 82 open to the pump outlet and in turn is embedded in a plastic pump end cap 84.

Interposed between end cap 84 and the inside of the cup cover element 70 is a circular plate 86 which retains connector 82 and the posts 72, 74. Between plate 86 and an end cap 84 is a foam rubber seal 88 which insulates the shell 20 and end cap 84 from the outer shell 50, 70. Connector nipple 80 and connector nipple 44 are connected by a short flexible hose 90 secured by hose clamps 92 and 94.

Figure 7:
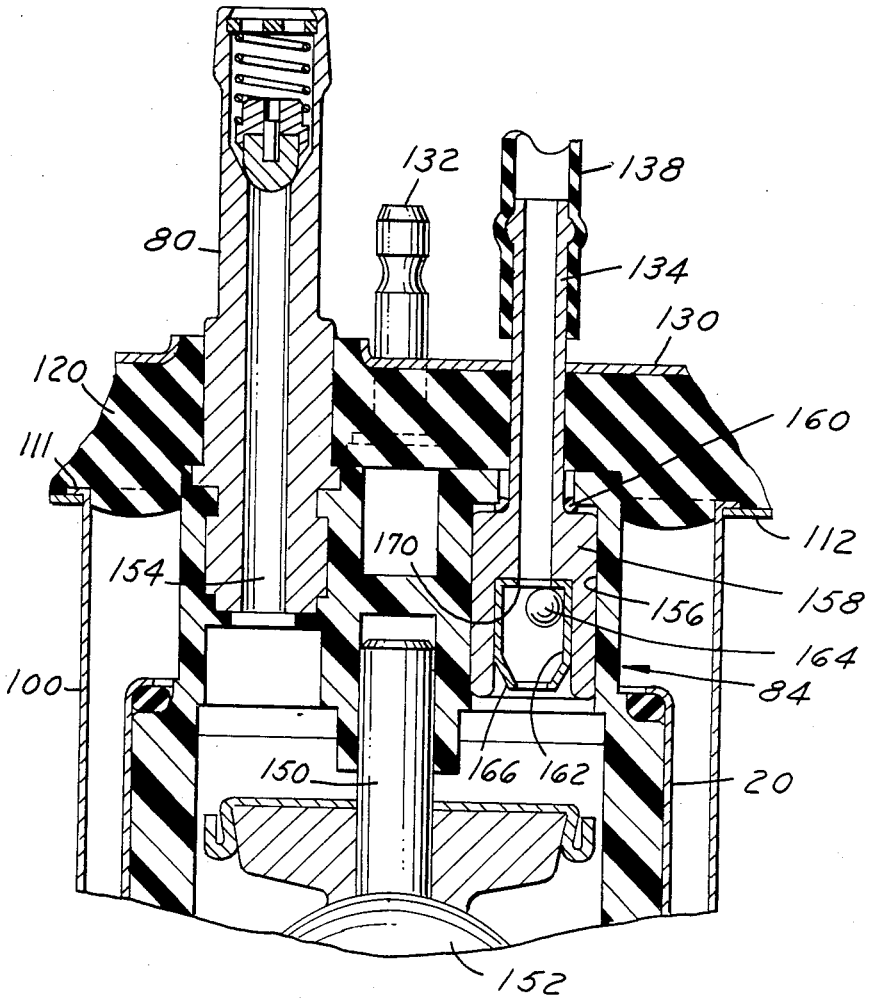
FIG. 7, a sectional view of the top end of the pump and mount.

In FIGS. 5, 6 and 7, a modified fuel pump mount is illustrated. This modified mount eliminates the hose connection to the tank cover by mounting the pump end cap directly to the fuel tank closure.

In FIG. 5, the pump housing shell 20 has the pump outlet 80 in the end cap 84 as described in connection with the modification of FIGS. 1 to 4. The outer shell 100 surrounding and spaced from the pump shell is a one-piece drawn part having a bottom fuel inlet opening 102 within an inturned flange 104. The lower end cap of the fuel pump 20 has a shoulder 106 on a necked down portion 108 to abut and be supported by a resilient rubber or plastic isolator ring 110 above the inturned flange 104.

The outer shell 100 has a short outwardly extending flange 111 which engages flange 112 of the tank cover. This flange 112 rises in an axial portion 114 to a second radial flange 116 which rises in a second axial flange 118. The upper flanged portion of housing 100 thus serves the same function as the top selflocking cover 30 illustrated in FIGS. 1, 2 and 3 in connecting the assembly in the opening in the top of the fuel tank.

The cupped portion of the cover element is filled with a foamed filler 120 of foamed, hydrocarbon-resistant rubber or plastic which isolates the pump from the housing 100. This foamed isolator pad is comprised and capped by a plate 130 which is suitably apertured to accommodate the outlet nipple 80, the electrical connector posts 132 and nipples 134 and 136. The nipples 134, 136 are connected by a U-tube 138.

In FIG. 7, a more detailed sectional view of the outlet end of the fuel pump is shown. The shaft 150 mounts the upper end of the armature 152 in the pump end cap 84. Fuel flows from the pump upwardly through the armature housing to the outlet 154 leading to the nipple 80.

Parallel to the outlet 154 is a recess 156 in which a valve housing insert 158 is located sealed by an O-ring 160. The valve housing insert rises to the outlet nipple 134 leading to the U-tube 138. A valve case 162 within the insert 158 houses a ball 164 which is trapped by the inturned end 166. It will be seen that the nipple 136 enters the fuel tank in passing down through plate 130 and flange 112. This ball valve 164 serves as a vapor purge for the pump. When the pump is idle, the ball 164 will drop into the case 162 and open the nipple 134. Thus, any vapor in the pump can rise and purge to the fuel tank. The tapered portion of the valve case 162 will allow flow if the valve is seated at the bottom. When the pump is actuated, pressure will develop in the armature chamber and cause vapor to move out of the pumping chamber. When liquid reaches the vapor outlet, the ball 164 will rise and close seat 170 to allow normal pumping of liquid fuel.

The pump assembly shown in FIG. 5 is entirely supported on the closure plate 112, 130. However, extensions may be added to the necked down portion of the shell 100 to extend to a fuel filter at the bottom of the fuel tank in which the pump is mounted.

In each embodiment, the inner pump housing is spaced from the outer housing leaving an air space between the two housings except for the resilient seals which exclude the fuel in the fuel tank in which the housings are submerged. The resilient seals not only excluse fuel from the surrounding air space but also serve as vibration barriers so that any pump noise is isolated from the interior of a vehicle in which the pump is being used.

What is claimed as new is:

1. A fuel pump tank mount for a self-contained pump and motor assembly having an elongate sealed pump housing with a fuel inlet projecting at one end and a fuel outlet projecting at the other end from said sealed housing which comprises;

(a) an elongate rigid mounting shell completely enclosing said pump housing and having side and end walls spaced from the side and end walls of said sealed pump housing to form an air space completely surrounding said housing, said fuel inlet and fuel outlet projecting from the respective ends of said shell, (b) resilient means at the respective ends of said shell to surround said projecting fuel inlet and fuel outlet respectively and space them from said shell and seal said air space, (c) said resilient means serving to support said pump housing in said shell in said spaced relation, (d) a tank support for said pump housing and said shell comprising and opening formed in the top of said tank, and (e) means to close said opening comprising:

(1) an annular flange secured to the top of said shell having a rim to seat in said tank opening, (2) a cover element overlying said flange, and (3) a relatively thick resilient material sandwiched between said flange and said cover element serving as one of said resilient means sealing said shell at the outlet end of said pump.

* * * * *